United States Patent [19]

Cataldo et al.

[11] 3,987,382

[45] Oct. 19, 1976

[54] UNITIZED MOTOR STARTER

[75] Inventors: John B. Cataldo, Moorestown, N.J.; Frank W. Kussy, Haverford; Frank R. Keller, Villanova, both of Pa.

[73] Assignee: I-T-E Imperial Corporation, Spring House, Pa.

[22] Filed: July 22, 1975

[21] Appl. No.: 598,052

[52] U.S. Cl. ..... 335/6; 335/8; 335/11; 335/16; 337/6

[51] Int. Cl.[2] ..... H01H 73/00; H01H 83/00

[58] Field of Search ..... 335/6, 8, 9, 10 (11), 335/18 (42); 337/6, 7, 54

[56] References Cited

UNITED STATES PATENTS

| | | | |
|---|---|---|---|
| 2,928,997 | 3/1960 | Edmunds | 337/54 |
| 3,040,144 | 6/1962 | Norden | 337/54 |
| 3,559,120 | 1/1971 | Myers | 335/42 |
| 3,636,482 | 1/1972 | Edmunds | 335/6 |
| 3,638,157 | 1/1972 | Kruzic | 337/6 |

*Primary Examiner*—Harold Broome
*Attorney, Agent, or Firm*—Ostrolenk, Faber, Gerb & Soffen

[57] ABSTRACT

A unitized combination motor starter is provided with a single insulated housing wherein a plurality of pole units are disposed side-by-side. Each pole unit includes a circuit breaker contact section and a contactor contact section. A spring powered mechanism for circuit breaker operation is disposed on one side of the pole units and an electromagnet for contactor operation is disposed on the other side of the pole units. The current carrying elements of each pole unit are arranged to provide a current loop having relatively close opposing arms so that large mechanical forces accompany high magnitude current flow. These forces are directed so as to produce a blow-off effect at the circuit breaker contacts, resulting in current limiting action to protect the contactor contacts. A removable and replaceable overload sensing electromagnet is provided for each of the pole units, and the coils thereof are of relatively high impedance to act as a current limiter during short circuit conditions to thereby protect heaters of overload relays connected in series with the unitized combination.

14 Claims, 4 Drawing Figures

FIG. 3
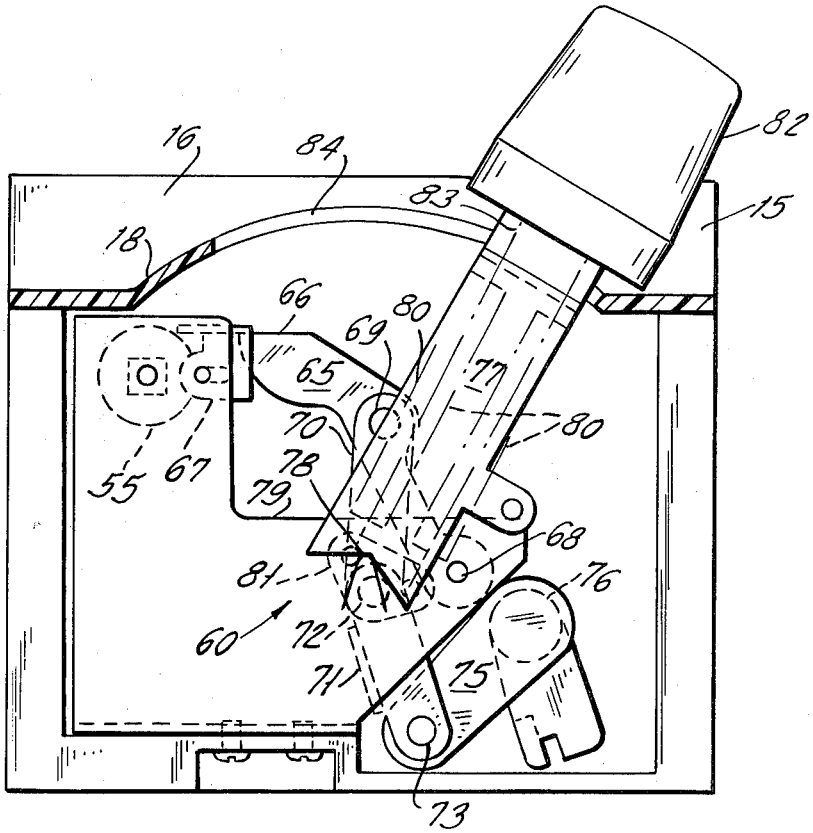
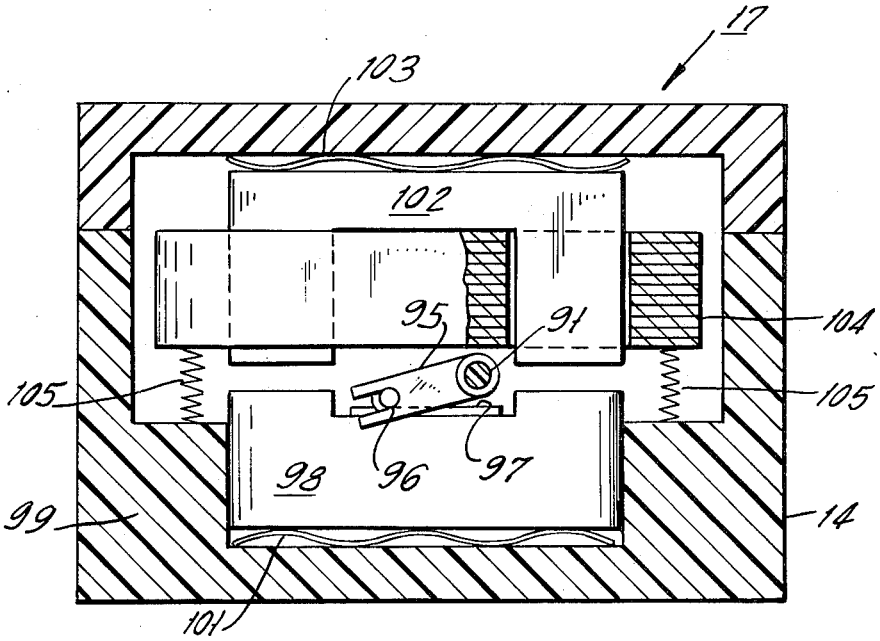
FIG. 4

UNITIZED MOTOR STARTER

This invention relates to motor starters in general and more particularly relates to a unitized device including an electromagnetic contactor and a manually operable switching means.

In the prior art, so-called combination motor starters often consisted of an electromagnetic contactor unit wired to a separate switch or circuit breaker. This type of apparatus was usually bulky and was often deficient from an electrical standpoint because the individual contactor and switch units available were not compatible to the extent necessary for achieving reliable operation under all conditions.

In accordance with the instant invention, a unitized motor starter is provided, including a single molded insulating housing divided into compartments for the current carrying elements of each pole. Other compartments are provided in the housing for the circuit breaker operating mechanism and the electromagnet of the contactor. The compartments for the pole units are disposed adjacent each other, the circuit breaker spring powered contact operating mechanism is disposed in a compartment on one side of the pole units, and the electromagnet for the contactor is disposed on the other side of the pole units.

The contactor and circuit breaker contact means share a common stationary contact means disposed at a sharp bend in a loop formed by the movable contacts of the contactor and circuit breaker. This loop is elongated, having closely spaced legs so that under high current conditions a strong blow-off effect is achieved. This blow-off effect limits circuit breaker current. The movable contact for the contactor is constructed so that while the circuit breaker contact is subjected to the blow-off effect the contactor movable contact is subjected to a blow-on effect.

Additional current limiting is achieved by utilizing a relatively high inductance coil for the overload sensing unit of the circuit breaker automatic trip device. Under short-circuit conditions, where current rises very rapidly, the impedance of this coil limits let-through energy to a value that will not damage heaters of overload relays connected in series with the unitized motor starter. This is especially advantageous for relatively small heaters, say in circuits where full load current is in the 10 to 16 ampere range. In units for use with motors drawing greater than 16 amperes for full load motor current, the weak link is the contactor contacts which, according to teachings of the instant invention, are protected by the current limiting blow-off effect at the circuit breaker contacts. The calibration range of the circuit breaker section is readily changed by removing and replacing the sensing coils, and calibration adjustment of all units is achieved simultaneously from a single point outside the device housing.

Accordingly, a primary object of the instant invention is to provide a unitized motor starter including an electromagnetic contactor in combination with a switch or circuit breaker.

Another object is to provide a unitized motor starter constructed so that upon the occurrence of a short circuit, magnetic forces tend to open the circuit breaker contacts, thereby producing a current limiting action and magnetic forces tend to close the contactor contacts.

Still another object is to provide a combination motor starter in which the circuit breaker portion is provided with removable and replaceable overload sensing coils.

A further object is to provide a combination motor starter having overload sensing coils which presents a sufficiently high impedance under short-circuit conditions to protect overload relays connected in series with the starter.

A still further object is to provide a unitized motor starter which when calibrated for use in relatively low current circuits will protect heaters of overload relays connected thereto because of utilization of high impedance current limiting overload sensing coils, and when calibrated for use in relatively high current circuits will protect the contactor contacts because of current limiting blow-off effects at the circuit breaker contacts.

These objects as well as other objects of this invention shall become readily apparent after reading the following description of the accompanying drawings in which:

FIG. 3 is a cross-section taken through line 3—3 of FIG. 1 looking in the direction of arrows 3—3 and showing the elements of the manual operating mechanism for the circuit breaker portion.

FIG. 4 is a cross-section taken through line 4—4 of FIG. 1 looking in the direction of arrows 4—4 and showing elements of the electromagnetic operative for the contactor portion.

Figure 1:
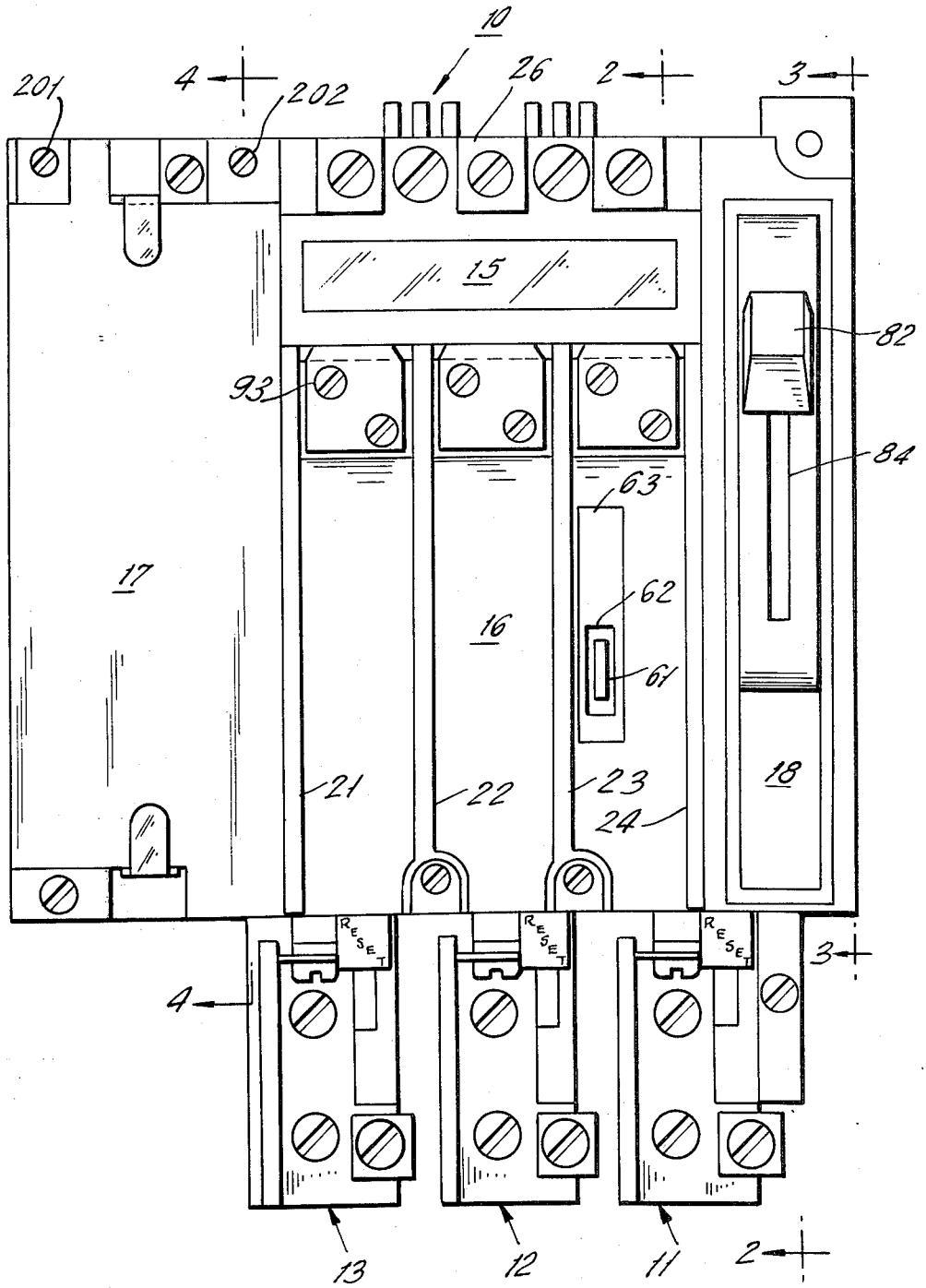
FIG. 1 is a plan view of a unitized combination motor starter constructed in accordance with the instant invention and connected to overload relay means.

Now referring to the figures. In FIG. 1 unitized combination motor starter is shown with three overload relay units 11, 12, 13 connected to starter 10 at its load end. Each of the overload relay units is of a type described in detail in U.S. Pat. No. 3,226,510 issued Dec. 28, 1965, to Thomas et al. for An Electric Overload Switch With Improved Thermal Actuator.

Figure 2:
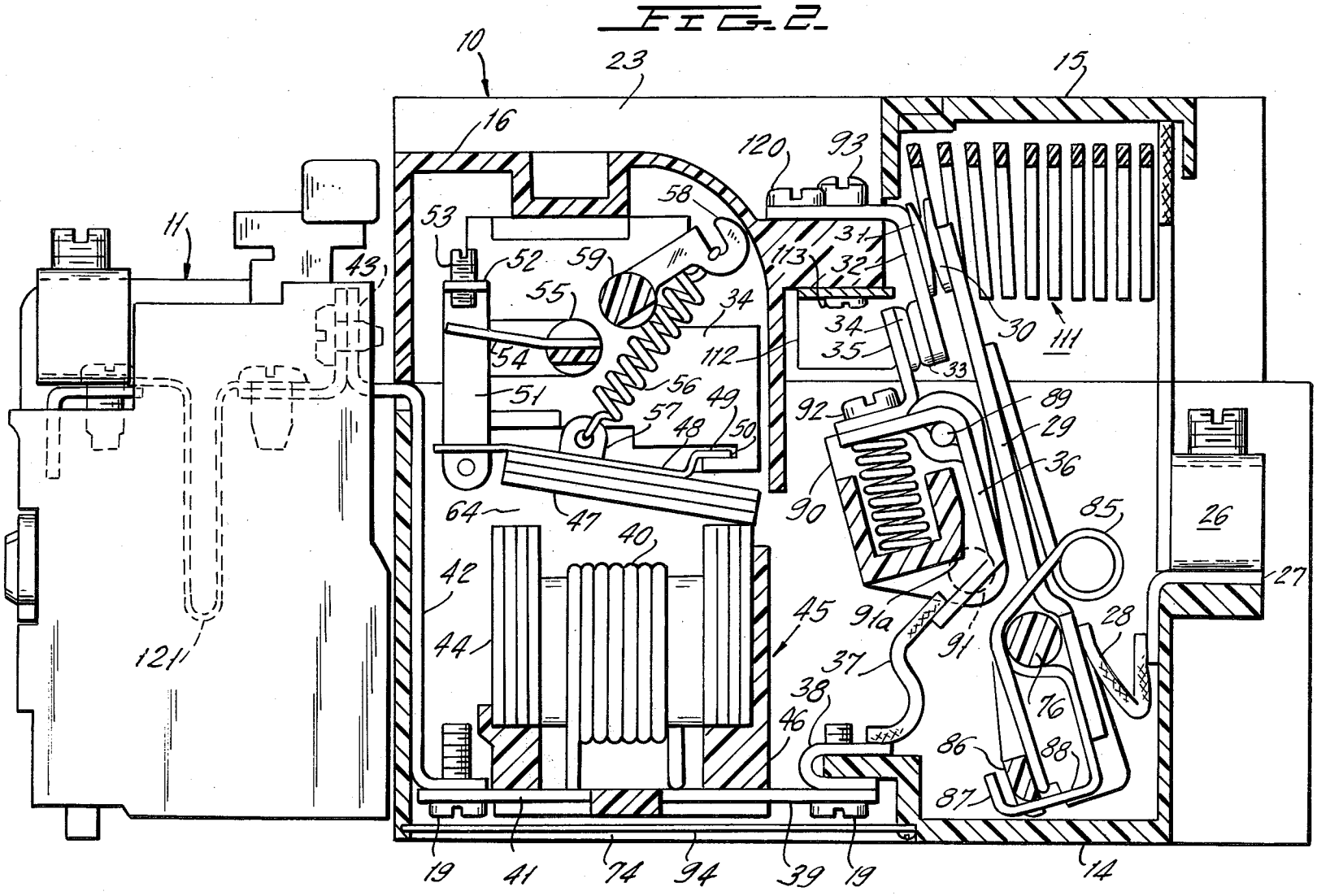
FIG. 2 is a cross-section taken through line 2—2 of FIG. 1 looking in the direction of arrows 2—2 and showing the elements of one pole unit.

Unitized starter 10 includes a molded insulating housing consisting of base 14 and removable cover portions 15, 16, 17, and 18. Cover portion 16 includes four longitudinally extending parallel ribs 21–24 aligned with similar ribs in base 14 to form three compartments each of which house elements identical to those illustrated in FIG. 2. These elements include the current-carrying elements for each of the three poles of starter 10. Similarly, cover section 15 is provided with internal ribs (not shown) aligned with ribs 21–24.

The current-carrying path for each of the pole units is identical so that only one of these paths shall be described. This path includes wire grip 26, lime terminal 27, flexible braid 28, movable switch contact arm 29, movable switch contact 30, stationary switch contact 31, terminal strap 32, stationary contactor contact 33, movable contactor contact 34, movable contactor switch arms sections 35, 36, flexible braid 37, U-shaped terminal 38, strap 39, overload sensing coil 40, strap 41, and strap 42 having an offset upper end constituting load terminal 43.

Coil 40 is part of removable and replaceable circuit breaker calibrating assembly 45 that is secured in operative position by a pair of screws 19, 19 accessible at the rear of base 14 by removing plate 74 which normally covers opening 94. Coil 40 is wound about the web section of U-shaped magnetic yoke 44 which, together with the other elements 39–41 of assembly 45, are secured to mounting member 46. Movable armature 47 is secured to spring element 48 having offset end 49 which extends into base recess 50 to operatively position armature 47. The end of member 48 opposite offset 49 is secured to the lower end of connector 51 having offset upper end 52 through which adjusting screw 53 extends. The lower end of screw 53 is engageable with the free end of extension 54 projecting generally radially from pivoted common tripper bar 55. The latter extends transversely through all of the pole units and into the compartment housing circuit breaker operating mechanism 60 (FIG. 3), for a reason to be hereinafter explained. Coiled tension spring 56 is connected at one end to ear 57 extending upward from element 48 and at the other end is connected to the free end of crank 58 extending generally radially from pivoted common adjusting rod 59. Rod 59 is held in its angularly adjusted position by means of a spring (not shown) which engages indentations in arm 62. Rod 59 is moved to a desired angular position by inserting a tool (not shown) into slot 61 at the free end of arm 62 that projects radially from rod 59 and is accessible through aperture 63 in the portion of cover part 16 between ribs 23, 24. Spring 56 biases the left end of armature 47 (when viewed in FIG. 2) away from yoke 44 to form air gap 64 in the magnetic frame 44, 47, gap 64 being constant regardless of the position of crank 58.

When the flux in magnetic frame 44, 47 generated by current flow in sensing coil 40 exceeds a predetermined level, armature 47 is attracted to yoke 44, carrying screw 53 into engagement with extension 54 thereby rotating tripper bar 55 in a counterclockwise direction. This releases intermediate latch 67 (FIG. 3) which, in turn, releases latching tip 66 of cradle 65. The latter is mounted to fixed pivot 68 and at a point 69 intermediate the ends of cradle 65. The latter is pivotally connected to upper toggle arm 70 which is connected to lower toggle arm 71 at knee 72 and is pivotally connected at pin 73 to the end of crank 75 remote from contact tie rod 76 keyed to crank 75. Handle extension 77 is pivotally mounted at its lower end to formation 78 of mechanism frame 79 and is biased thereagainst by a pair of coiled tension springs 80, 80 connected at their upper ends to handle extension 77 and at their lower ends to triangular plate 81 through which toggle knee pin 72 extends. Manually engageable operating handle 82 is removably mounted to the upper end 83 of handle extension 77. End 83 of extension 77 extends through and rides in slot 84 (FIG. 1) of operating mechanism cover 18.

It should now be apparent that circuit operating mechanism 60 is of the trip-free spring powered overcentered toggle type well known to the circuit breaker art. Thus, when the line of action of operating springs 80, 80 shifts to collapse toggles 70, 71, tie bar 76 is pivoted clockwise with respect to FIGS. 2 and 3. Since contact arms 29 of all poles are mounted to tie rod 76, contact arms 29 also pivot clockwise thereby separating circuit breaker contacts 30, 31. Looped wire spring 85 bears against base formation 86 and contact arm 29 to bias the latter in a counterclockwise direction thereby normally supplying contact pressure. When contacts 30, 31 are disengaged, the counterclockwise motion of contact arm 29 is limited through the cooperation of base formation 86 and the upturned end 87 of member 88 which clamps contact arm 29 to tie bar 76.

Contact arm section 36 is mounted to pivot 89 on formation 90 which extends generally at right angles to the longitudinal axis of tie rod 91. Coiled compression spring bears against formation 90 and arm portion 36 to bias the latter clockwise with respect to FIG. 2 about pivot 89 as a center. This, in turn, provides contact pressure between contactor contacts 33, 34 when the latter are engaged. Portion 91a of formation 90 is engaged by arm portion 36 to limit clockwise movement of the latter when contactor contacts 33, 34 are disengaged. When cover portion 16 is removed, screw 92 connecting contacting arm portions 35, 36 is accessible for removal and replacement of removable contactor contact 34. Screw 93, accessible from the outside of cover portion 16, removably secures strap 32 in this operative position so that stationary contactor contact 33 may readily be removed and replaced.

Tie bar 91 extends into the housing compartment containing the electromagnet operator for contactor movable contacts 34. In this compartment tie bar 91 is keyed to one end of crank 95 whose other end is provided with an open-ended slot into which pin 96 extends. The latter projects from element 97 secured to movable U-shaped magnetic armature 98 mounted in holder 99 cushioned from base by corrugated spring 101. Inverted U-shaped yoke 102 is secured to cover portion 17 and is cushioned with respect thereto by corrugated spring 103. Double-loop magnet operating coil assembly 104 is mounted to yoke 102 and is biased upwardly by coiled compression springs 105, 105 which bear against armature 99 and also serve to bias the latter away from stationary yoke 102. When the coil assembly 104 is energized by an energizing voltage applied at terminals 201, 202, the flux in magnetic frame 98, 102 attracts armature 98 to yoke 102 thereby pivoting crank 95 clockwise with respect to tie rod 91 as a center. In turn, this causes clockwise rotation of tie rod 91 to pivot contactor movable contact arm 35, 36 clockwise with respect to FIGS. 2 and 4 thereby closing contactor contacts 33, 34.

The elements forming parallel plate arc chute 111 (FIG. 2) are secured to cover portion 15 on the interior thereof in operation position to facilitate extinction of arcs drawn between circuit breaker contacts 30, 31. Similarly, U-shaped steel element 112 is secured to the interior of cover portion 16 by screw 113 in operative position to assist in extinguishing arcs drawn between contactor contacts 33, 34. Screw 120 is threadably mounted to stationary contact member 31 to act as a binding post for making electrical connections through circuit breaker contacts 30, 31 to line terminal 27 without going through contactor contacts 33, 34. This type of electrical connection is required for certain control circuit configurations or when a reversing type contactor operation is desired.

It is noted that circuit breaker contact arm 29 and contactor contact arm 35, 36 together with their associated contacts are arranged to form a loop in which there is a relatively close spacing between conductive sections carrying currents in opposite directions. Thus, under short circuit conditions, large forces are developed which tend to drive contact arm 29 away from contact arm 35, 36. In particular, this large force creates a blow-off effect at circuit breaker contacts 30, 31 in that contact arm 29 is urged in a clockwise direction about its pivot 76. With the elements proportioned as illustrated, a large blow-off effect is free to move arm 29 more than halfway toward its fully open position before rod 76 is pivoted by mechanism 60. This produces a current limiting action in advance of contact separation brought about by tripping of circuit breaker operating mechanism 60 so that let-through energy is insufficient to damage contactor contacts 33, 34. At the same time, this force acts to the left (with respect to FIG. 2) on contact arm sections 35, 36. Since arm portion 36 is longer than arm portion 35, a larger force acts on portion 36 than on portion 35 so that the net effect is to urge contactor contact arm 35, 36 in a clockwise direction about pivot 89 to produce a blow-on effect for contactor contacts 33, 34.

It is also noted that the impedance of sensing coil 40 for the circuit breaker automatic trip meams is relatively high so that when utilized motor starter 10 is subjected to a short circuit or other fault conditions characterized by a rapid increase in current, the impedance presented by sensing coil 40 limits current until mechanism 60 separates contacts 30, 31, hence limits let-through energy for overload relay heater 121 (FIG. 2) in series with coil 40 to a value that will not damage heater 121.

Thus, it is seen that the instant invention provides a novel construction for a motor starter in which the circuit breaker and contactor contacts are in a common housing to achieve substantial saving of cost and space. Further, the arrangement of these contacts is such that current limiting action is achieved when the circuit breaker is called upon to open a circuit and at this time a blown-on effect is present at the contactor contacts. This current limiting action is especially useful in starters for relatively large motors. In starters used for relatively small motors the current limiting action of the high impedance overload sensing coil 40 protects small heaters of overload relays from damage.

While unitized motor starter 10 has been described as including an electromagnetic contactor in series with an automatic circuit breaker, it should be apparent to those skilled in the art that a unitized motor starter utilizing many features of the instant invention may be constructed by substituting a manually operated switch for the circuit breaker. It should also be apparent to those skilled in the art that the contactor portion may be provided with bridging type contacts to provide a double break. Further, provisions may be made to change the sensing coil and its magnetic yoke through an opening at the front of the starter rather than changing same through a rear opening as hereinbefore described.

Although there has been described a preferred embodiment of this novel invention, many variations and modifications will now be apparent to those skilled in the art. Therefore, this invention is to be limited not by the specific disclosure herein but only by the appending claims.

The embodiments of the invention in which an exclusive privilege or property is claimed are defined as follows:

1. A unitized switching device including a first and a second pole unit positioned side by side; each of said pole units including separable switch contact means and separable contactor contact means in series circuit with said switch contact means; a spring powered operating mechanism connected to said switch contact means of both said first and said second pole units for simultaneous opening and closing thereof; an electromagnetic operating means connected to said contactor contact means of both said first and said second contact means for simultaneous opening and closing thereof; said first pole unit being interposed between said second pole unit and said spring powered operating mechanism.

2. A unitized switching device as set forth in claim 1 in which each of the pole units includes an overload device operatively connected to said spring powered operating mechanism; said overload device upon sensing predetermined overload conditions in circuit with said switching device automatically actuating said spring powered operating mechanism to open said switch contact means.

3. A unitized switching device as set forth in claim 2 in which each of the overload devices includes a sensing coil in series circuit with the contact means; said sensing coil being removable and replaceable for the purpose of changing the calibration range of the switching device.

4. A unitized switching device as set forth in claim 2 in which each of the overload devices includes a sensing coil in series circuit with the contact means; said coil constructed to present a relatively high impedance to rapid current increases and thereby protect overload relays, connected in series with said switching device, during short circuit conditions.

5. A unitized switching device as set forth in claim 4 in which each of the overload devices also includes a stationary magnetic yoke and a magnetic armature mounted for movement relative to said yoke; said coil and said yoke being parts of a subassembly that is removable and replaceable, to change the calibration range of said switching device, while said armature remains operatively mounted as part of said switching device.

6. A unitized switching device as set forth in claim 2 in which each of the overload devices includes an adjusting means; tie means connected to the adjusting means of both of said pole units, whereby said adjusting means are adjusted simultaneously.

7. A unitized switching device as set forth in claim 1 also including housing means wherein said pole units are disposed; for each of said pole units said switch and said contactor contact means having stationary portions on a common element including a portion extending outside of said housing means for electrical connection to other devices.

8. A unitized switching device as set forth in claim 7 in which the housing means includes a removable cover to which said common elements are secured; an arc suppressing means secured to said cover and operatively positioned to receive electric current arcs drawn between said contact means upon separation thereof.

9. A unitized switching device including a first and a second pole unit each including separable switch contact means and separable contactor contact means in series circuit with said switch contact means; a spring powered operating means connected to said switch contact means of both said first and said second pole units for simultaneous opening and closing thereof; an electromagnetic operating means connected to said contactor contact means of both said first and said second pole units for simultaneous opening and closing thereof; said switch contact means including a movable arm forming part of a current loop having closely spaced legs whereby under high fault current conditions electrodynamic forces generated by current flowing in said loop, and acting on said arm, opens said switch contact means prior to opening thereof by said spring powered operating means thereby limiting let-through energy to a value that is withstandable by said contactor contact means without damage thereto.

10. A unitized switching device as set forth in claim 9 in which there is a common stationary section shared by said switch and said contactor contact means; said current loop also including a movable arm means constituting a portion of said contactor contact means; a pivot mounting for said arm means positioned closer to the end engageable with the stationary section than to the other end of the arm means whereby forces generated on said arm means by current flowing in said loop tends to close said contactor contact means.

11. A unitized switching device as set forth in claim 10 in which the arms are connected to the spring powered operating means and are pivotally mounted at the ends thereof remote from the stationary section.

12. A unitized switching device as set forth in claim 11 in which the arm means are connected to the electromagnetic operating means by a pivot means disposed at the other ends of the arm means.

13. A unitized switching device as set forth in claim 1 in which the electromagnetic operating means is disposed alongside one of said first and second pole units.

14. A unitized switching device as set forth in claim 1 in which the second pole unit is interposed between the first pole unit and the electromagnetic operating means.

* * * * *

UNITED STATES PATENT AND TRADEMARK OFFICE

CERTIFICATE OF CORRECTION

PATENT NO. : 3,987,382
DATED : October 19, 1976
INVENTOR(S) : John B. Cataldo et al It is certified that error appears in the above-identified patent and that said Letters Patent are hereby corrected as shown below:

Column 5, line 68 - please delete "contact means" and substitute therefor --pole units--

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*